US008754883B2

(12) United States Patent
Su et al.

(10) Patent No.: US 8,754,883 B2
(45) Date of Patent: Jun. 17, 2014

(54) CONTROL METHOD OF OUTPUT SIGNAL FROM TIMING CONTROLLER IN FLAT PANEL DISPLAY DEVICE

(75) Inventors: Shih-Yuan Su, Hsin-Chu (TW); Chao-Ching Hsu, Hsin-Chu (TW); Yi-Fan Lin, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 324 days.

(21) Appl. No.: 13/245,140

(22) Filed: Sep. 26, 2011

(65) Prior Publication Data

US 2012/0242647 A1 Sep. 27, 2012

(30) Foreign Application Priority Data

Mar. 21, 2011 (TW) ..... 100109605 A

(51) Int. Cl.
*G09G 5/00* (2006.01)

(52) U.S. Cl.
USPC ..... 345/213

(58) Field of Classification Search
CPC ... G09G 5/00; G09G 3/20; G09G 2310/0267; G09G 2310/06; G09G 2310/067; G09G 3/3266; G09G 3/3674; G09G 3/3611; G09G 2300/02; G09G 2300/023; G09G 2300/026
USPC ..... 345/204–215, 87–100
See application file for complete search history.

(56) References Cited

U.S. PATENT DOCUMENTS 6,947,022 B2 * 9/2005 McCartney ..... 345/99
8,471,804 B2 * 6/2013 Wu et al. ..... 345/99
2002/0084968 A1 7/2002 Park et al.
2003/0160753 A1 8/2003 McCartney
2005/0057480 A1 * 3/2005 Liao et al. ..... 345/98
2007/0097057 A1 * 5/2007 Shin ..... 345/98
2007/0242019 A1 10/2007 Jung et al.
2008/0018635 A1 * 1/2008 Kang ..... 345/210
2008/0117155 A1 5/2008 Li et al.
2008/0136809 A1 * 6/2008 Lee et al. ..... 345/214
2008/0273003 A1 * 11/2008 Jeon ..... 345/99
2009/0189836 A1 * 7/2009 Hu ..... 345/87
2009/0189883 A1 * 7/2009 Chung et al. ..... 345/213

(Continued)

FOREIGN PATENT DOCUMENTS

TW 201027502 A1 7/2010
TW 201042617 A1 12/2010
TW 201113857 4/2011

OTHER PUBLICATIONS

Taiwan Patent Office, Office Action, Nov. 7, 2013.

*Primary Examiner* — Dwayne Bost
*Assistant Examiner* — Ivelisse Martinez Quiles
(74) *Attorney, Agent, or Firm* — WPAT, PC; Justin King

(57) ABSTRACT

An exemplary control method of an output signal (e.g., from a timing controller in a flat panel display device) is adapted to be operative with a first signal with multiple pulses. In the control method, during a first time segment including part of the pulses of the first signal, a first enable signal is provided passing through a transmission path after a first time length from a rising edge of each of the part of the pulses. During a second time segment including another part of the pulses of the first signal, a second enable signal is provided passing through a part of the transmission path after a second time length from a rising edge of each of the another part of the pulses. The first time length is shorter than the second time length.

7 Claims, 5 Drawing Sheets

(56) References Cited

U.S. PATENT DOCUMENTS

2009/0219242 A1* 9/2009 Fuchigami et al. ..... 345/100
2010/0171688 A1* 7/2010 Wang ..... 345/99
2010/0177089 A1 7/2010 Huang et al.
2010/0245333 A1* 9/2010 Hsu et al. ..... 345/213
2010/0295765 A1* 11/2010 Hsiao et al. ..... 345/98
2011/0084894 A1 4/2011 Siao et al.

* cited by examiner

CONTROL METHOD OF OUTPUT SIGNAL FROM TIMING CONTROLLER IN FLAT PANEL DISPLAY DEVICE

TECHNICAL FIELD

The present disclosure generally relates to a control method of an output signal for driving circuit, and more particularly to a control method of an output signal for driving a gate circuit in a display device.

BACKGROUND

With the development of electronic display technologies, flat panel display devices such as active-type light emitting diode (LED) liquid crystal display (LCD) devices are widely applied into electronic devices.

A driving circuit as an essential part of the liquid crystal display device generally includes multiple gate driver integrated circuits (ICs). For the liquid crystal display device with half source driving (HSD) structure in which pixels are arranged in zigzag manner, an gate enable time is half shorten with respect to the other type LCD devices, so that when a source line changes display data signals thereon, it would easily cause wrongly charged voltages for pixels because of incompletely turned off gate pulses, resulting in line mura in displayed images. In addition, since the arrangement of gate lines and source lines, signal delays are caused so that the phenomenon of H-block occurred.

In order to solve the issue of line mura, a sloping circuit generally is used in the prior art to modulate the waveforms of gate pulses, so as to relieve the effect of the distortion of gate pulses applied to the image brightness of left-sided and right-sided pixels of a single source line.

However, since wires between gate driver ICs are formed in wire on array (WOA) manner, such wires cause the delay of output enable (OE) signal for the gate driver ICs, which would result in that different gate driver ICs have different feed-through and sloped voltages. As a result, output signals from different gate driver ICs would have a voltage difference ($\Delta V$), resulting in the occurrence of color unevenness caused by H-band or 3-band in displayed images.

Referring to FIG. 1, waveforms of output signals of gate driver ICs and their waveform differences in the prior art are shown. Two gate driver ICs Y1, Y2 are taken as an example, in the prior art, since the wire layout between the gate driver ICs, the time of an output enable signal OE arriving at the gate driver IC Y1 is later than the time of the output enable signal OE arriving at the gate driver IC Y2 on the assumption of the transmission path of output enable signal being firstly passing through the gate driver IC Y2 and then arriving at the gate driver IC Y1, so that turned-on times of the respective gate driver ICs are different times with respect to a sloping voltage VGG1, and therefore a voltage difference is consequently produced between sloped portions of gate control signals G1, G2 outputted from the respective gate driver ICs Y1, Y2, i.e., V1 is not equal to V2 as illustrated in FIG. 1.

In order to relieve the above-described voltage difference, a conventional solution is to lengthen the period of logic low level of the output enable signal OE. However, in such HSD-type display device, a high-speed scanning operation is necessary, so that the conventional solution would cause the gate enable time being excessively short, resulting in more insufficient charging time of display data signal.

In short, due to the delay of output enable signal, the issues such as different turned-on times of gate driver ICs, signals being wrongly charged, and the sloped voltage difference between different gate control signals are raised.

SUMMARY OF DISCLOSURE

Therefore, the present disclosure is directed to a control method of an output signal, so as to overcome the issues caused by the delay of output enable signal.

The present disclosure is further directed to a control method of an output signal from a timing controller in a flat panel display device, so as to overcome the issues caused by the delay of output enable signal.

More specifically, a control method of an output signal in accordance with an exemplary embodiment is adapted to be operative with a first signal with multiple pulses. In the control method, a first enable signal is provided passing through a transmission path after a first time length from a rising edge of each of part of the pulses in the first signal during a first time segment including the part of the pulses, and a second enable signal is provided passing through a part of the transmission path after a second time length from a rising edge of each of another part of the pulses in the first signal during a second time segment including the another part of the pulses. The first time length is shorter than the second time length.

In one embodiment, the second time segment for providing the second enable signal is followed after the first time segment for providing the first enable signal.

In one embodiment, a difference between the sum of a first transmission time of the first enable signal consumed on the transmission path added with the first time length and the sum of a second transmission time of the second enable signal consumed on the part of the transmission path added with the second time length is shorter than the difference between the first transmission time and the second transmission time.

A control method of an output signal in accordance with another exemplary embodiment is adapted to be operative with a first signal with multiple pulses. In the control signal, a threshold number is firstly set, and an output pulse is provided multiple times in a manner of one output pulse being provided after each of the pulses of the first signal. Before the number of the output pulse being provided achieves the threshold number, the output pulse is provided after a first time length from a rising edge of each of part of the pulses of the first signal. After the number of the output pulse being provided achieves the threshold number, the output pulse is provided after a second time length from the rising edge of each of another part of the pulses of the first signal. The first time length is different from the second time length.

A control method of an output signal from a timing controller in a flat panel display device in accordance with still another exemplary embodiment is adapted to control a timing of the output signal for use in multiple gate drivers. In the control method, a first signal containing multiple pulses is firstly provided to the timing controller. A first enable signal then is generated from the timing controller to one of the gate drivers through a transmission path after a first time length from a rising edge of each of part of the pulses during a first time segment of the first signal, and further a second enable signal is generated from the timing controller to another of the gate drivers through a part of the transmission path after a second time length form the rising edge of each of another part of the pulses during a second time segment of the first signal. The first time length is shorter than the second time length.

A control method in accordance with even still another exemplary embodiment includes steps of: providing a first enable signal passing through a first transmission path after a first time length from a rising edge of a first signal; and providing a second signal passing through a second transmission path after a second time length from another rising edge of the first signal. The first time length is longer than the second time length, and the first transmission path is shorter than the second transmission path.

In summary, due to the gate drivers at different positions being provided with the output enable signals at different times, the difference between the arrived-times of the enable signals for different gate drivers can be compensated. As a result, the issues of different turned-on times for different gate drivers, signals being wrongly charged, and sloped voltage difference, etc. in the prior art can be avoided, so that the uneven brightness is improved.

BRIEF DESCRIPTION OF THE DRAWINGS

The above objects and advantages of the present disclosure will become more readily apparent to those ordinarily skilled in the art after reviewing the following detailed description and accompanying drawings, in which.

DETAILED DESCRIPTION OF EMBODIMENTS

The present disclosure will now be described more specifically with reference to the following embodiments. It is to be noted that the following descriptions of embodiments of this invention are presented herein for purpose of illustration and description only. It is not intended to be exhaustive or to be limited to the precise form disclosed.

Figure 1:
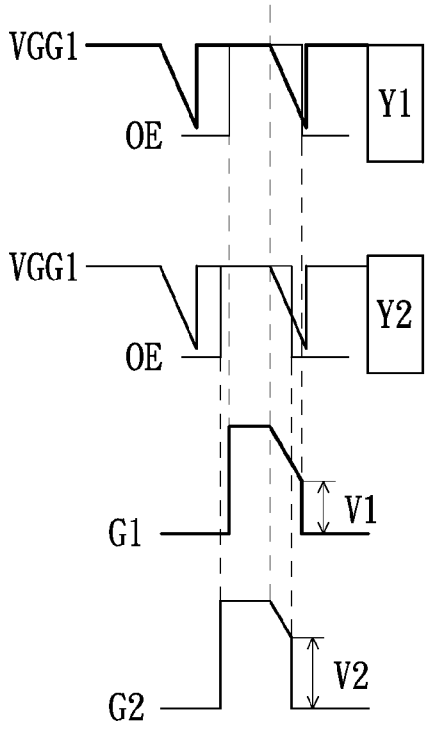
FIG. 1 (Prior Art)
FIG. 1 shows waveforms of output signals of gate driver ICs and their waveform differences in the prior art.
Figure 2:
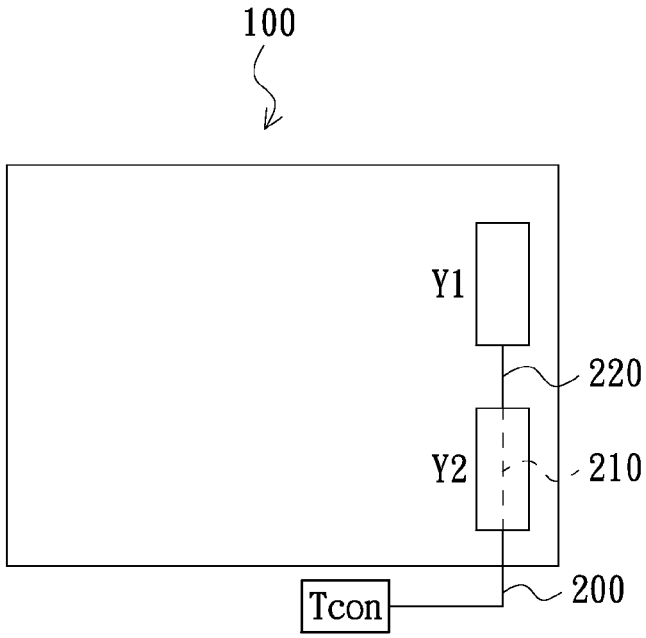
FIG. 2 is a schematic arrangement of gate driver ICs in accordance with an exemplary embodiment.

Referring to FIG. 2, a schematic arrangement of gate driver ICs in accordance with an exemplary embodiment is shown. It is understood that, the gate driver ICs (i.e., gate drivers in the form of ICs) can be replaced by gate drivers on array that are generally directly formed on a pixel array substrate concurrently with a pixel manufacturing process of display device. Specifically, in the illustrated embodiment, two gate driver ICs included in a driving circuit of a display panel 100 are taken as an example for the purpose of description. As illustrated in FIG. 2, the display panel 100 includes a gate driver IC Y1 and a gate driver IC Y2. A signal transmission path includes a first part signal transmission path 200 from a timing controller Tcon to the gate driver IC Y2, a second part signal transmission path 210 inside (or outside) of the gate driver IC Y2 and a third part signal transmission path 220 from the end of the second part signal transmission path 210 to the gate driver IC Y1.

Figure 3:
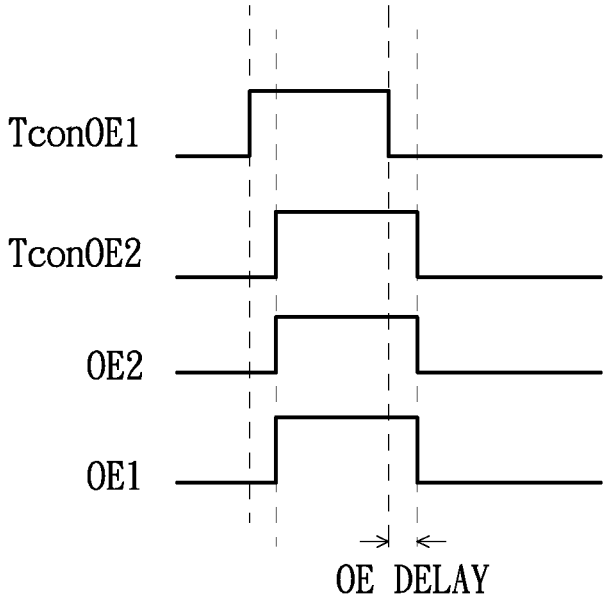
FIG. 3 is a timing diagram of timing enable signals and enable signals for gate driver ICs in accordance with an exemplary embodiment.

Referring to FIG. 3, a timing diagram of timing enable signals and correspondingly-generated enable signals for gate driver ICs in accordance with an exemplary embodiment is shown. The timing enable signal TconOE1 outputted from the timing controller Tcon serves as an enable signal OE1 for the gate driver IC Y1 after arriving at the gate driver IC Y1. Likewise, the timing enable signal TconOE2 outputted from the timing controller Tcon serves as an enable signal OE2 for the gate driver IC Y2 after arriving at the gate driver IC Y2.

In the ideal situation, a time point of the timing enable signal TconOE1 arriving at the gate driver IC Y1 ought to be the same as that of the timing enable signal TconOE2 arriving at the gate driver IC Y2 However, in the actual application, since the signal transmission path from the timing controller Tcon to the gate driver IC Y1 (including the first part signal transmission path 200, the second part signal transmission path 210 and the third part signal transmission path 220, hereinafter also referred to as first transmission path) is longer than the signal transmission path from the timing controller Tcon to the gate driver IC Y2 (only including the first part signal transmission path 200, hereinafter also referred to as second transmission path), so that the time length of a signal transmitted from the timing controller Tcon to the gate driver IC Y1 is longer than the time length of the same signal transmitted from the timing controller Tcon to the gate driver IC Y2 (herein, it is assumed that there is a time delay difference of OE DELAY). Accordingly, in order to relieve even eliminate the effect applied to the enable signals OE1, OE2 for the respective gate driver ICs Y1, Y2 caused by the difference of the transmission paths, a time point of generating the timing enable signal TconOE1 is designed to be before a time point of generating the timing enable signal TconOE2.

Figure 4:
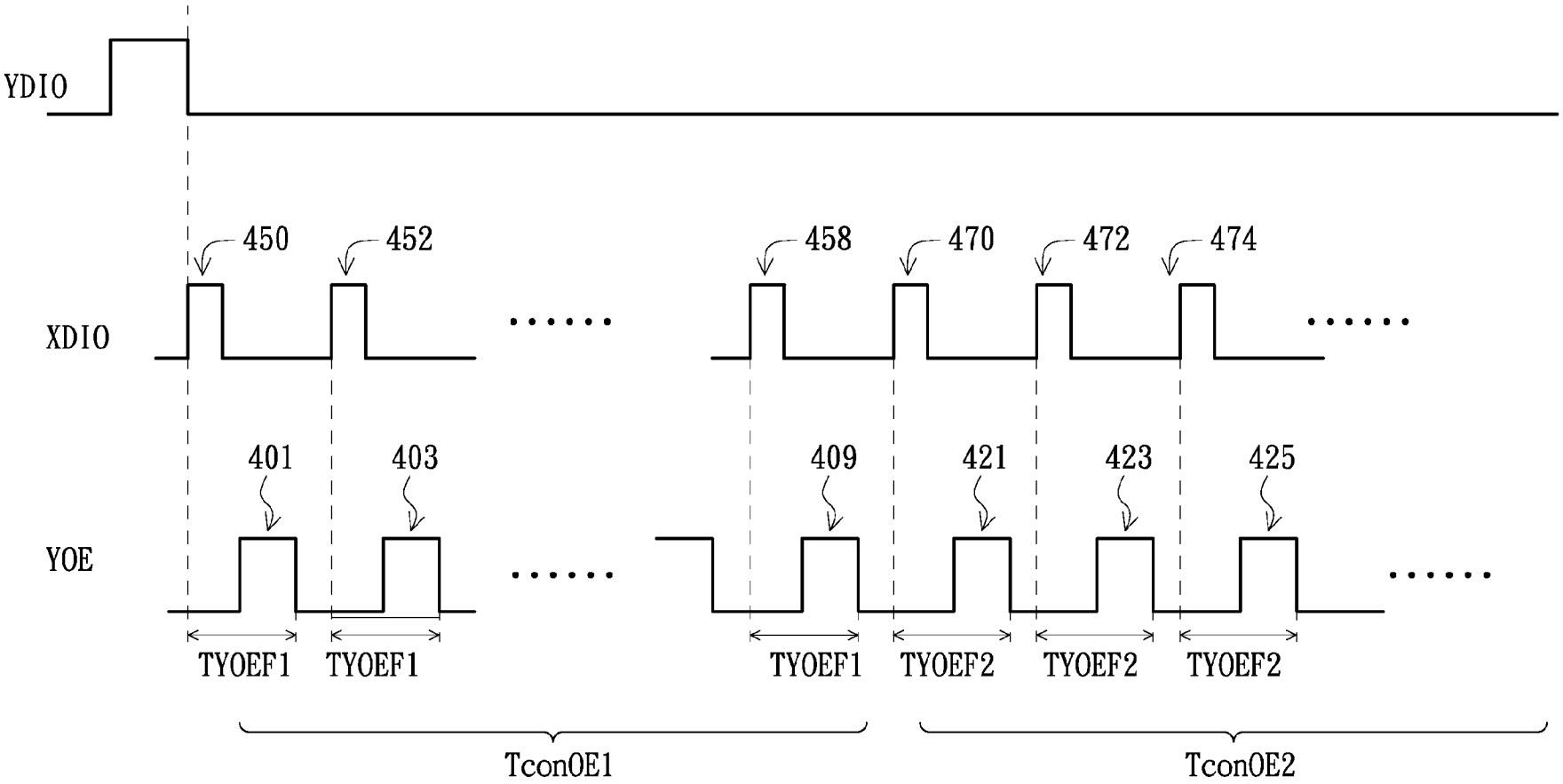
FIG. 4 shows a timing diagram of a timing enable signal in accordance with an exemplary embodiment.

Referring to FIG. 4, a timing diagram of a timing enable signal in accordance with an exemplary embodiment is shown. As illustrated in FIG. 4, an exemplary first signal XDIO is a signal with a fixed, constant frequency provided to the timing controller Tcon. The timing controller Tcon generates a timing enable signal YOE (including the above-described timing enable signals TconOE1, TconOE2) according to the first signal XDIO. It is assumed that a scanning order of gate lines in the display panel 100 is from up to down, that is, in FIG. 2, the gate driver IC Y1 is firstly operated and then the gate driver IC Y2 is operated. In the timing enable signal YOE, the formerly-generated pulses 401~409 (corresponding to the above-described timing enable signal TconOE1) would be transmitted to the gate driver IC Y1 through the first transmission path, and the latterly-generated pulses 421~425 (corresponding to the above-described timing enable signal TconOE2) would be transmitted to the gate driver IC Y2 through the second transmission path (i.e., a part of the first transmission path).

It is noted that, in the exemplary embodiment, although the pulses of the timing enable signal YOE are produced after rising edges of the respective pulses of the first signal XDIO, the time points of generating the pulses in the timing enable signal YOE may be designed to be after falling edges of the respective pulses of the first signal XDIO instead.

Still referring to FIG. 4, the pulses 401~409 in the timing enable signal YOE each is completely-generated (i.e., the timing enable signal YOE generates a falling edge) after a first time length TYOEF1 from the rising edge of the corresponding one of the pulses 450~458 in the first signal XDIO. The pulses 421~425 in the timing enable signal YOE each is completely-generated after a second time length TYOEF2 from the rising edge of the corresponding one of the pulses 470~474 in the first signal XDIO. Herein, the pulses 401~409 and the pulses 421~425 generally have the same pulse width. Since the condition that the time length of a signal transmitted to the gate driver IC Y1 being longer than that of the same signal transmitted to the gate driver IC Y2 is taken in consideration, during generating the pulses in the timing enable signal YOE, the first time length TYOEF1 is designed to be shorter than the second time length TYOEF2. As a result, when the relatively long pulse transmission time is compensated by a relatively former pulse generation time, the time delay difference of OE DELAY between the enable signals OE1 and OE2 for the respective gate driver ICs Y1, Y2 can be shorten even eliminated.

In other words, the inventive purpose is to make a difference between the sum of the transmission time for transmitting the timing enable signal TconOE1 added with the first time length TYOEF1 and the sum of the transmission time for transmitting the timing enable signal TconOE2 added with the second time length TYOEF2 be less than the time delay difference of OE DELAY.

Figure 5:
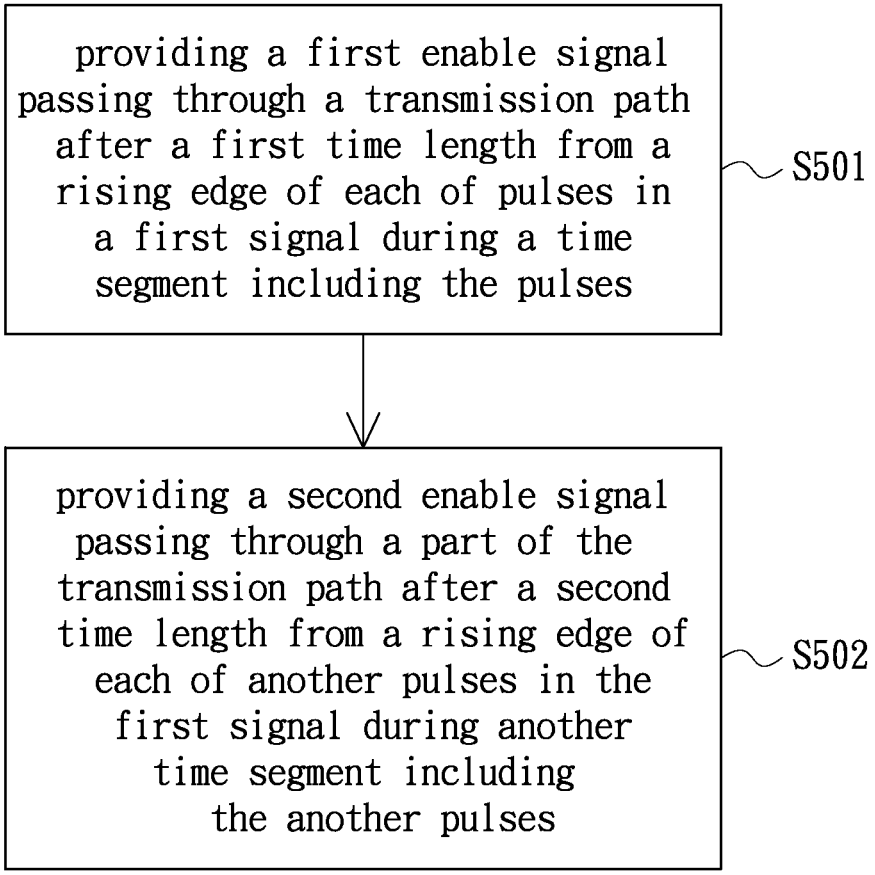
FIG. 5 is a flowchart of a control method of an output signal in accordance with an exemplary embodiment.

The above-described exemplary embodiment can be summarized as the flowchart of FIG. 5. Referring to FIG. 4 and FIG. 5 together, FIG. 5 shows an implementation steps flowchart in accordance with an exemplary embodiment. In the illustrated embodiment, during a first time segment of the first signal XDIO (for example, the time interval between the rising edge of the pulse 450 and the rising edge of the pulse 470), the timing enable pulses TconOE1 are completely-generated to the first transmission path after the first time length TYOEF1 from the rising edges of the respective pulses e.g., 450~458 (step S501), so as to provide the timing enable pulses TconOE1 to the gate driver IC Y1 for use. During another time segment of the first signal XDIO (for example, after the rising edge of the pulse 470), the timing enable pulses TconOE2 are completely-generated to the second transmission path after the second time length from the rising edges of the respective pulses 470~474 (step S502), so as to provide the timing enable pulses TconOE2 to the gate driver IC Y2 for use.

Furthermore, in a general design, each of the gate driver ICs Y1, Y2 would drive a certain number of gate lines, and therefore in the situation of sequentially driving, the pulses in the timing enable signal YOE would be sequentially provided to enable the gate lines. Accordingly, the generation times of pulses in the timing enable signal YOE can be determined by simply calculating the number of pulses in the timing enable signal YOE.

Referring back to FIG. 2 and FIG. 4 together, it is assumed that the gate driver IC Y1 is for driving 256 number of gate lines and the gate driver IC Y2 is for driving 512 number of gate lines. A count value can be reset at the time of appearing a start pulse signal YDIO, and the count value then is added one when the timing enable signal YOE generates each pulse. Since the transmission designation of the pulses in the timing enable signal YOE before the count value arriving at 256 is the gate driver IC Y1, and after the first time length TYOEF1 from the rising edge of each pulse in the first signal XDIO, the timing enable signal YOE generates one pulse. Likewise, since the transmission designation of the pulses of the timing enable signal YOE when the count value fall in the range of 257~768 is the gate driver IC Y2, and after the second time length TYOEF2 from the rising edge of each pulse in the first signal XDIO, the timing enable signal YOE generates one pulse.

Figure 6:
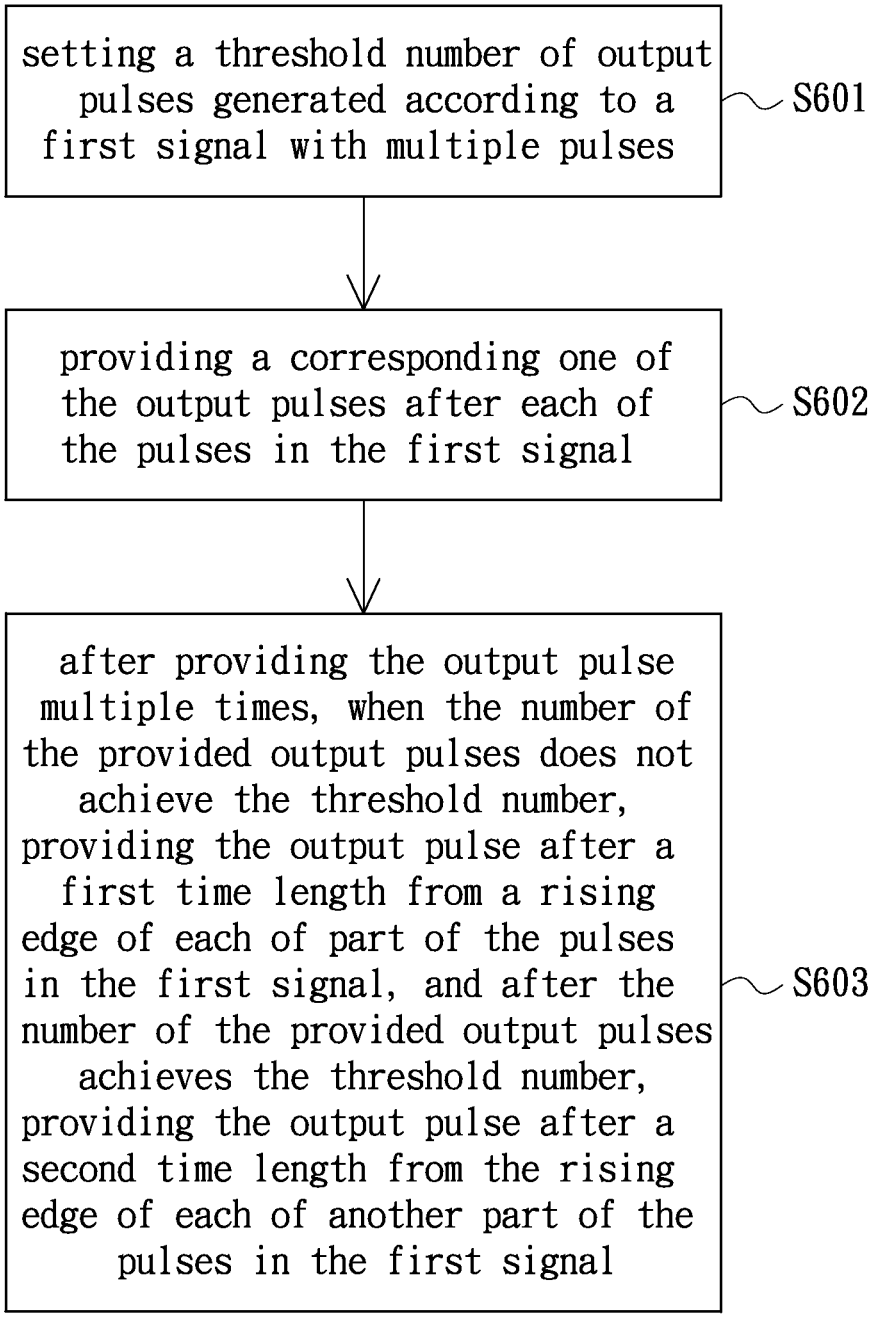
FIG. 6 is a flowchart of a control method of an output signal in accordance with another exemplary embodiment.

Such exemplary embodiment as describe above can be summarized as the flowchart in FIG. 6. Referring to FIG. 4 and FIG. 6 together, FIG. 6 is an implementation steps flowchart in accordance with another exemplary embodiment. As depicted in FIG. 6, a threshold number (for example, the above-mentioned 256) is firstly set (step S601), and one pulse of the timing enable signal YOE is provided after each of multiple pulses of the first signal XDIO (step S602). After multiple times of providing the pulse of the timing enable signal YOE e.g., successively, if the number of the provided pulses of the timing enable signal YOE does not achieve the threshold number, the time point after the first time length TYOEF1 from the rising edge of each of part of the pulses of the first signal XDIO is defined as the time point of completely-generating one pulse of the timing enable signal YOE; whereas, if the number of the provided pulses of the timing enable signal YOE exceeds the threshold number, the time point after the second time length TYOEF2 from the rising edge of each of another part of the pulses of the first signal XDIO is defined as the time point of completely-generating one pulse of the timing enable signal YOE (step S603).

The above description is based on the assumption of the gate driver IC Y1 firstly being performed with gate line scanning operation and then the gate driver IC Y2 being performed gate line scanning operation. If the gate driver IC Y2 firstly is performed with gate line scanning operation and then the gate driver IC Y1 is performed with gate line scanning operation, the threshold number ought to be changed as 512 (i.e., the amount of gate lines driven by the gate driver IC Y2) instead, correspondingly at the beginning, the time point after the second time length TYOEF2 from the rising edge of each pulse of the first signal XDIO is defined as the time point of completely-generating one pulse of the timing enable signal YOE, and then after the count value arriving at the threshold number, the time point after the first time length TYOEF1 from the rising edge of each pulse of the first signal XDIO is defined as the time point of completely-generating one pulse of the timing enable signal YOE.

In addition, for other design of the signal transmission path starting from the timing controller Tcon and then passing through the gate driver IC Y1 and finally arriving at the gate driver IC Y2, since the transmission path of transmitting a signal to the gate driver IC Y2 is longer than the transmission path of transmitting the same signal to the gate driver IC Y1, the first time length TYOEF1 preferably is designed to be greater than the second time length TYOEF2.

To sum up, in the above various embodiments, owning to the enable signals for different gate drivers being outputted at different time points for changing and controlling the sloped waveforms of gate control signals, the difference between the enable signals for the different gate drivers can be compensated. Accordingly, the issues in the prior art such as different turned-on times for different gate driver ICs, signals being wrongly charged and the sloped voltage difference can be avoided, and therefore the uneven brightness is improved.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A control method of an output signal from a timing controller in a flat panel display device, to control a timing of the output signal for use in a plurality of gate drivers of the flat panel display device, the control method comprising:

providing a first signal including a plurality of pulses to the timing controller;

generating a first enable signal from the timing controller to one of the gate drivers through a transmission path after a first time length from a rising edge of each of part of the pulses in the first signal, during a first time segment of the first signal including the part of the pulses; and generating a second enable signal to another of the gate drivers through a part of the transmission path after a second time length from the rising edge of each of another part of the pulses in the first signal, during a second time segment of the first signal including the another part of the pulses;

wherein the first time length is shorter than the second time length.

2. The control method as claimed in claim 1, wherein a difference between the sum of a first transmission time of the first enable signal consumed on the transmission path added with the first time length and the sum of a second transmission time of the second enable signal consumed on the part of the transmission path added with the second time length is smaller than a difference between the first transmission time and the second transmission time.

3. The control method as claimed in claim 1, further comprising:

setting a threshold number;

providing an output pulse after each of the pulses in the first signal, wherein the output pulse is selectively one of the first enable signal and the second enable signal; and multiple times of providing the output pulse;

wherein one of the first time segment and the second time segment is a time period of the number of the provided output pulses being not achieve the threshold number, and the other one of the first time segment and the second time segment is a time period after the number of the provided output pulses achieving the threshold number.

4. The control method as claimed in claim 3, wherein when the output pulse provided before achieving the threshold number has a relatively long target transmission distance, and the output pulse provided after achieving the threshold number has a relatively short target transmission distance, the first time length is smaller than the second time length.

5. The control method as claimed in claim 3, wherein when the output pulse provided before achieving the threshold number has a relatively short target transmission distance, and the output pulse provided after achieving the threshold number has a relatively long target transmission distance, the first time length is greater than the second time length.

6. The control method as claimed in claim 1, wherein the second time segment for providing the second enable signal is followed after the first time segment for providing the first enable signal.

7. The control method as claimed in claim 1, wherein the first time segment for providing the first enable signal is followed after the second time segment for providing the second enable signal.

* * * * *